US008067335B2

(12) United States Patent
Roth et al.

(10) Patent No.: US 8,067,335 B2
(45) **Date of Patent: *Nov. 29, 2011**

(54) MULTISIDED THERMAL MEDIA COMBINATIONS

(75) Inventors: Joseph D Roth, Springboro, OH (US); Wendell B Halbrook, Waynesville, OH (US); Paul C Blank, La Crosse, WI (US)

(73) Assignee: NCR Corporation, Duluth, GA (US)

( * ) Notice: Subject to any disclaimer, the term of this patent is extended or adjusted under 35 U.S.C. 154(b) by 1144 days.

This patent is subject to a terminal disclaimer.

(21) Appl. No.: 11/595,364

(22) Filed: Nov. 9, 2006

(65) Prior Publication Data

US 2007/0244005 A1 Oct. 18, 2007

Related U.S. Application Data

(60) Provisional application No. 60/779,781, filed on Mar. 7, 2006, provisional application No. 60/779,782, filed on Mar. 7, 2006.

(51) Int. Cl.
*B41M 5/30* (2006.01)

(52) U.S. Cl. ..... 503/206; 156/271; 427/150; 427/152; 503/204; 503/226

(58) Field of Classification Search ..... None
See application file for complete search history.

(56) References Cited

U.S. PATENT DOCUMENTS

| | | | |
|---|---|---|---|
| 3,466,423 | A | 9/1969 | Janning |
| 3,518,406 | A | 6/1970 | Janning |
| 3,663,390 | A | 5/1972 | Fergason et al. |
| 3,947,854 | A | 3/1976 | Hansen et al. |
| 4,161,277 | A | 7/1979 | Steiner |
| 4,167,392 | A | 9/1979 | Defago |
| RE30,116 | E | 10/1979 | Maalouf |
| 4,309,255 | A | 1/1982 | Gendler et al. |
| 4,507,669 | A | 3/1985 | Sakamoto et al. |
| 4,631,596 | A | 12/1986 | Yaguchi |
| 4,708,500 | A | 11/1987 | Bangs et al. |
| 4,806,950 | A | 2/1989 | Sekine et al. |
| 4,853,256 | A | 8/1989 | Obringer et al. |

(Continued)

FOREIGN PATENT DOCUMENTS

| | | |
|---|---|---|
| EP | 0947340 | 10/1999 |

(Continued)

OTHER PUBLICATIONS

JP Abstract, vol. 007,No. 063 (M-200), Mar. 16, 1983 & JP 57-208298 A (Ricoh KK), Dec. 21, 1982.

(Continued)

*Primary Examiner* — Bruce H Hess
(74) *Attorney, Agent, or Firm* — Charles Q. Maney

(57) ABSTRACT

Various multisided thermal media image elements, and methods of manufacture thereof, are presented. In one embodiment, a first media substrate is at least partially coated with thermally sensitive ink on one or more of its sides. A second media substrate is coated with the thermally sensitive ink on at least one of its sides. The second media substrate is at least partially integrated with the first media substrate to form a multisided thermal media image element, wherein at least a portion of the second media substrate is capable of being removed for independent use. The multisided first and second media substrates are adapted to be imaged via a thermal printer individually and together upon integration into the image element.

17 Claims, 8 Drawing Sheets

U.S. PATENT DOCUMENTS 4,956,251 A 9/1990 Washizu et al.
4,965,166 A 10/1990 Hosoi et al.
4,987,118 A 1/1991 Murata et al.
5,055,373 A 10/1991 Saeki et al.
5,101,222 A 3/1992 Hakkaku
5,130,292 A 7/1992 Ito et al.
5,132,704 A 7/1992 Nakagawa
5,196,297 A 3/1993 Dombrowski, Jr. et al.
5,214,750 A 5/1993 Minowa et al.
5,266,550 A 11/1993 Asajima et al.
5,272,127 A 12/1993 Mandoh et al.
5,284,816 A 2/1994 Stephenson
5,319,392 A 6/1994 Durst et al.
5,339,099 A 8/1994 Nureki et al.
5,366,952 A * 11/1994 Granquist ..... 503/204
5,398,305 A 3/1995 Yawata et al.
5,428,714 A 6/1995 Yawata et al.
5,437,004 A 7/1995 Miyasaka et al.
5,476,698 A 12/1995 Denny
5,537,550 A 7/1996 Russell et al.
5,555,349 A 9/1996 Miyasaka et al.
5,584,590 A 12/1996 Ito et al.
5,585,321 A 12/1996 Breen et al.
5,594,653 A 1/1997 Akiyama et al.
5,629,259 A 5/1997 Akada et al.
5,639,169 A 6/1997 Aruga
5,667,303 A 9/1997 Arens et al.
5,677,722 A 10/1997 Park
5,686,159 A 11/1997 Langan
5,688,057 A 11/1997 Wright et al.
5,692,110 A 11/1997 Miyasaka et al.
5,707,925 A 1/1998 Akada et al.
5,710,094 A 1/1998 Minami et al.
5,727,135 A 3/1998 Webb
5,741,592 A 4/1998 Lewis et al.
5,754,213 A 5/1998 Whritenor
5,755,521 A 5/1998 Ito et al.
5,756,188 A 5/1998 Reiter et al.
5,763,356 A 6/1998 Ueno et al.
5,781,823 A 7/1998 Isobe et al.
5,789,340 A 8/1998 Brust et al.
5,792,725 A 8/1998 Simpson et al.
5,794,530 A 8/1998 Dobashi et al.
5,800,081 A 9/1998 Teradaira et al.
5,815,191 A 9/1998 Michielsen et al.
5,846,900 A 12/1998 Reiter et al.
5,876,836 A 3/1999 Imamura et al.
5,883,043 A 3/1999 Halbrook, Jr. et al.
5,886,725 A 3/1999 Miyadera et al.
5,918,910 A * 7/1999 Stillwagon et al. ..... 283/67
5,964,541 A 10/1999 Murison et al.
5,980,128 A 11/1999 Verlinden et al.
6,000,726 A 12/1999 Campbell
6,000,867 A 12/1999 Yoshii et al.
6,042,264 A 3/2000 Prusik et al.
6,095,414 A 8/2000 Long et al.
6,106,910 A 8/2000 Tan et al.
6,118,956 A 9/2000 Hirao
6,130,185 A 10/2000 Narita et al.
6,150,067 A 11/2000 Koike et al.
6,151,037 A 11/2000 Kaufman et al.
6,165,937 A 12/2000 Puckett et al.
6,197,722 B1 3/2001 Irving et al.
6,210,517 B1 4/2001 Eadara et al.
6,210,777 B1 4/2001 Vermeulen et al.
6,233,057 B1 5/2001 Ota
6,241,386 B1 6/2001 Limburg et al.
6,258,746 B1 7/2001 Mehta et al.
6,267,052 B1 7/2001 Hill et al.
6,350,072 B1 2/2002 Nunes et al.
6,388,692 B1 5/2002 Iwata et al.
6,416,154 B1 7/2002 Silverbrook
6,523,951 B2 2/2003 Takeya et al.
6,524,000 B1 2/2003 Roth
6,543,808 B1 4/2003 Mitchell, Jr. et al.
6,544,709 B1 4/2003 Wang et al.
6,544,925 B1 4/2003 Prusik et al.
6,562,755 B1 5/2003 Halbrook, Jr. et al.
6,663,304 B2 12/2003 Vives et al.
6,705,786 B2 3/2004 Trovinger
6,737,137 B2 5/2004 Franko, Sr. et al.
6,759,366 B2 7/2004 Beckerdite et al.
6,784,906 B2 8/2004 Long et al.
6,786,263 B1 9/2004 Fox, Jr. et al.
6,801,233 B2 10/2004 Bhatt et al.
6,803,344 B2 10/2004 Halbrook et al.
6,812,943 B1 11/2004 Day et al.
6,906,735 B2 6/2005 Bhatt et al.
6,962,449 B2 11/2005 Lermant et al.
6,962,763 B2 11/2005 Maskasky et al.
6,982,737 B2 1/2006 Elko et al.
7,192,904 B2 3/2007 Iwasaki et al.
7,514,262 B2 4/2009 Ribi
7,520,586 B2 4/2009 Itoh
7,589,752 B2 9/2009 Janning
7,623,145 B2 11/2009 Taguchi
7,671,878 B2 3/2010 Yamada et al.
7,760,370 B2 7/2010 Oki
2001/0034775 A1 10/2001 Minowa
2002/0122188 A1 9/2002 Elko et al.
2002/0124950 A1 9/2002 Klima
2003/0025779 A1 2/2003 Miyazaki
2003/0031861 A1 2/2003 Reiter et al.
2003/0112318 A1 6/2003 Long et al.
2003/0208560 A1 11/2003 Inoue et al.
2004/0046971 A1 3/2004 Lapstun et al.
2004/0084631 A1 5/2004 Spoonhower et al.
2004/0265542 A1 12/2004 Yanagisawa et al.
2005/0020387 A1 1/2005 Kennedy, III
2005/0031392 A1 2/2005 Yamamoto et al.
2005/0146739 A1 7/2005 Rayl et al.
2005/0146740 A1 7/2005 Fukuda
2005/0148467 A1 7/2005 Makitalo et al.
2005/0164881 A1 7/2005 Kenney et al.
2005/0271866 A1 12/2005 Lee
2006/0072001 A1 4/2006 Klein
2006/0289633 A1 12/2006 Moreland et al.
2007/0109349 A1 5/2007 Tanaka et al.
2007/0207926 A1 9/2007 VanDemark et al.
2007/0223022 A1 9/2007 Suzuki
2009/0184510 A1 7/2009 Frankel
2009/0195584 A1 8/2009 Itoh
2009/0225353 A1 9/2009 Ishibashi
2010/0225932 A1 9/2010 Kurose et al.

FOREIGN PATENT DOCUMENTS

EP 1 862 318 5/2007
EP 1 862 319 5/2007
GB 2 250 478 6/1992
JP 58008668 1/1983
JP 58051172 5/1983
JP 03234560 10/1991
JP 03293171 12/1991
JP H07061141 8/1993
JP 06262786 9/1994
JP H09086041 9/1995
JP 08127152 5/1996
JP 08169127 7/1996
JP 2000315275 11/2000
JP 2001080131 3/2001
JP 2001199095 7/2001
JP 2003251595 9/2003
JP 09-183427 9/2004
JP 2006095755 4/2006
JP 2006256289 9/2006
WO 2004077001 A1 9/2004
WO 2007102879 9/2007

OTHER PUBLICATIONS

JP Abstract, vol. 007, No. 081 (M-105), Apr. 5, 1983, & JP 58-008668 A (Shinko Denki KK), Jan. 18, 1983.

JP Abstract, vol. 015, No. 194 (M-1114), May 20, 1991 & JP 03-051149 A (Fujitsu General Ltd.), Mar. 5, 1991.

JP Abstract, vol. 2000, No. 24, May 11, 2001 & JP 2001-199095 A (Alps Electric Co. Ltd.), Jul. 24, 2001.

JP Abstract, vol. 1998, No. 08, Jun. 30, 1998 & JP 10-076713 A (Sony Corp.), Mar. 24, 1998.
JP Abstract, vol. 010, No. 151 (M-483), May 31, 1986 & JP 61-003765 A (Konishiroku Shashin Kogyo KK), Jan. 9, 1986.
JP Abstract, vol. 016, No. 041 (M-1206), Jan. 31, 1992 & JP 03-246091 A (Canon Inc.), Nov. 1, 1991.
Boca Systems Micro Plus 2S 2 Sided Printer product Brochure which came to the attention of Applicant at a Chicago tradeshow during the summer of 2002.

* cited by examiner

MULTISIDED THERMAL MEDIA COMBINATIONS

RELATED APPLICATIONS

The present application claims priority to U.S. Provisional Patent Application Nos. 60/779,781 and 60/779,782, filed on Mar. 7, 2006; both of which are hereby incorporated by reference herein in their entireties.

FIELD

The invention relates generally to thermally coated media applications and more particularly to multisided thermal media combinations.

BACKGROUND

Thermal printing is becoming increasingly popular and cost effective in the retail industry. With thermal printing, the ink is pre-coated on paper-based media where it is subsequently and selectively revealed by applying heat from a thermally-enabled printer (thermal printer). One obvious benefit to this technique is the lack of a need to purchase consumables, such as ink or laser cartridges. Another benefit is that the thermal printer may require less maintenance and may not have to be serviced as often, since there is no ink running through components of the printer and no cartridges to continually remove and install within the printer.

SUMMARY

In various embodiments, multisided thermal media combinations and methods of manufacture are provided. In an example embodiment, an image element is presented that includes a first substrate and a second substrate. The first substrate has front and back sides; at least of portion of the front and back sides are coated with thermally sensitive ink. The second substrate includes front and back sides, and at least a portion of the front side is coated with thermally sensitive ink. Furthermore, the back side of the second substrate is at least partially integrated to the front side of the first substrate.

DETAILED DESCRIPTION

Figure 1B:
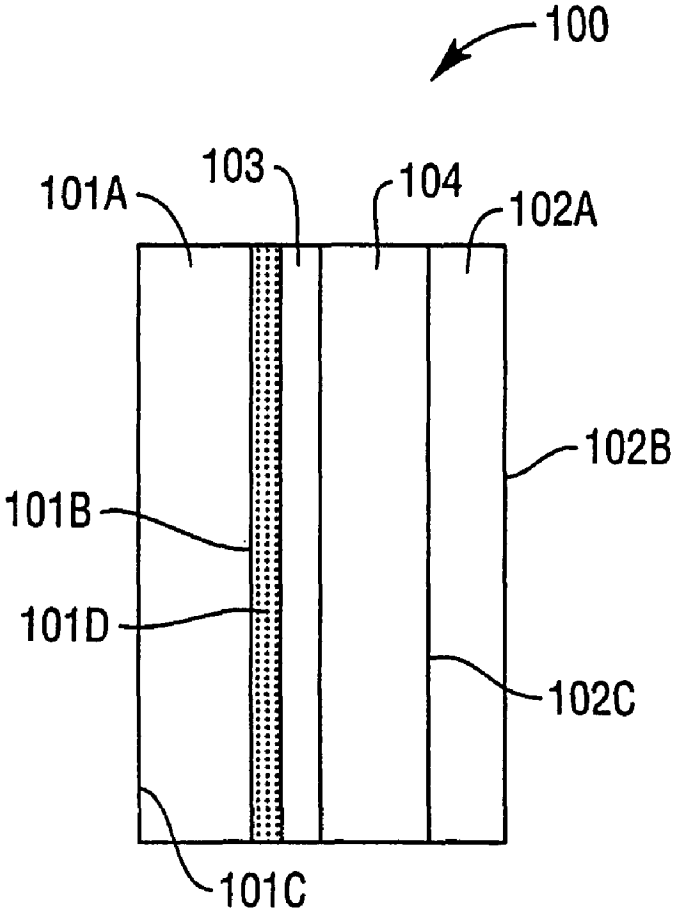
FIG. 1B is a diagram of an image element according to FIG. 1A additionally comprising a liner, according to an example embodiment.
Figure 1A:
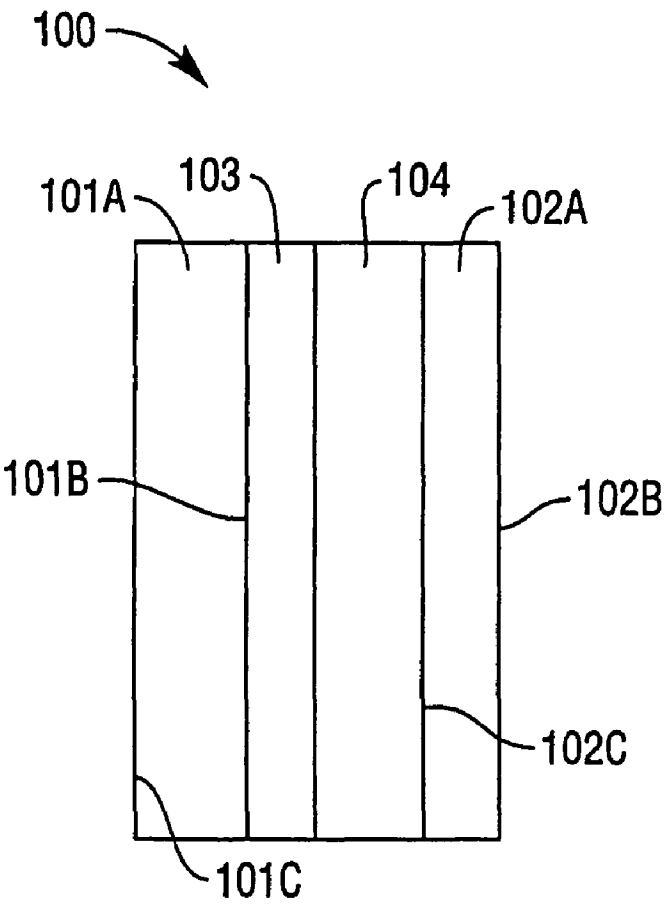
FIG. 1A is a diagram of an image element, according to an example embodiment.

FIG. 1A and FIG. 1B are diagrams of an image element 100, according to an example embodiment. The image element 100 comprises a composite of substrates (101A, 102A) that are selectively coated with thermally sensitive ink. The ink may be single (e.g., black, white, etc.) or multi colored. When heat is applied to one or more of the substrates, the respective inks are imaged and may, depending on, inter alia, the native color of the substrate, become visible. To achieve this, a thermal printer may be used. The thermal printer may print on a single side (e.g., 101C) of the image element 100 or on both sides (101C, 102B) of the image element 100.

An example of thermal sensitive media may be found with U.S. Pat. No. 6,759,366 and an example of a thermal printer may be found with U.S. Pat. No. 6,784,906; the disclosures of which are incorporated by reference herein. Essentially, thermally sensitive media is fed to a thermal printer, which selective applies heat to that media causing the ink to be revealed on the media. The thermal printer applies heat to reveal ink on the media; so, there is no consumable, such as ink, that has to be supplied to the printer.

The image element 100 includes a first substrate 101A and a second substrate 102A. In some cases, the image element 100 may include one or more additional substrates. Depending on the application, the first substrate 101A may be referred to as a "base sheet" and the second substrate 102A may be referred to as a "patch." Each of the first and second substrates will now be discussed in turn.

The first substrate 101A is a unit of thermally sensitive media that includes two sides: a front side 101B and a back side 101C. Some or all of the front side 101B may be coated with thermally sensitive ink. Likewise, some or all of the back side 101C may be coated with thermally sensitive ink. It is noted that single (e.g., black, white, mono color) or multiple colors may be coated on the sides 101B and 101C. Likewise, single or multiple thermally sensitive inks may be used in each coating.

The dimensions of the first substrate 101A are also configurable according to fabrication specifications. Thus, the first substrate 101A may take on any desired height and width, such as but not limited to A4, Legal, 8½ by 11 inches, etc. In some cases, multiple first substrates 101A may be fabricated in a continuous roll, such that any single first substrate 101A is identified by a perforation, a sense mark, and/or other programmatic mechanism to subsequently cut or otherwise distinguish and identify a single first substrate 101A.

The material of the first substrate 101A may be any substrate including paper-based media or other media that is capable of being coated with thermally sensitive ink and subsequently fed through and processed within a thermal printer. For example, suitable substrate materials can be derived from natural and/or synthetic fibers such as cellulose (natural) (e.g., opaque paper) and polyester (synthetic) fibers. Substrates may also include plastics (e.g., extruded plastic films) using materials such as Kapton, polyethylene or polyester polymers. In some cases the material may be cloth, paper, cardboard, plastic, metal, composite materials, and the like. Furthermore, calendaring or super calendaring may be used to improve the quality of the first substrate 101A and to provide a desired smoothness.

The thermally sensitive ink or inks used to coat the front side 101B and the back side 101C of the first substrate 101A may be accompanied by a variety of other coatings above and/or below the thermally sensitive ink coating. Additionally, the thermally sensitive ink coatings on each side of the first substrate 101A can provide single color printing on each side of the first substrate 101A, where the print colors are the same or different on each side of the first substrate 101A. Alternatively, multiple color direct thermal printing may be implemented on one side or both sides (101B and 101C), using multiple thermally sensitive coatings or multiple thermally sensitive layers within a coating, e.g., as taught in U.S. Pat. No. 6,906,735, or using multiple dyes within a coating layer, where the available print color choices are the same or different on each side of the first substrate 101A.

In some embodiments, the thermally sensitive coatings, including any multicolor coatings, may be applied as a spot or pattern as opposed to a full side coating, such as when printing within that coating is expected to only cover a limited area of either the front side 101B and/or the back side 101C of the first substrate 101A.

The image element 100 also includes a second substrate 102A (patch) that is fabricated to be an integral part of (integrated) or otherwise affixed to the first substrate 101A (base sheet). Yet, the patch 102A is also an independent piece of media that includes a front side 102B and a back side 102C. The front side 102B is coated with thermally sensitive ink in manners and with coatings as described above with respect to the front side 101B and the back side 101C of the base sheet 101A.

It is noted that in some cases at least some portions of the patch 102A are permanently affixed to the front side 101B of the base sheet 101A. This may be achieved by not including a release agent 103, such as silicone, in a region proximate to 1 or more (usually 2 or 4) edges of the patch 102A. Then, an adhesive, such as a pressure sensitive adhesive (PSA), coated on at least a portion of the back side 102C of the patch 102A including the 1 or more edges, or coated on at least a portion of the front side 101B of the base sheet 101A proximate to the edges of the back side 102C of the patch 102A, forms a permanent bond between the edges of the patch 102A and the base sheet 101A.

According to an embodiment, the back side 102C of the patch 102A may include pre-printed information if desired or it may be blank. This permits information to be visible when the patch 102A, or a portion thereof, is removed from the base sheet 101A. The removable portion of the patch 102A may be die cut from the other portions of the patch 102A that are affixed to the base sheet 101A.

It is also noted that the entire patch 102A may be detachable or capable of being removed from the base sheet 101A.

According to an embodiment, the back side 102C of the patch 102A is interfaced to the front side 101B of the base sheet 101A. This can be done in a variety of manners. For example, the back side 102C of the patch may include an adhesive (such as a PSA, etc.) 104 and the front side 101B of the base sheet 101A may include a release agent 103, such as by way of example only, a transparent silicone coating. This permits an area of the front side 101B of the base sheet 101A that interfaces with the back side 102C of the patch 102A to include pre-printed information that is revealed when the patch 102A, or a portion thereof, is removed from the base sheet 101A. As previously noted, the back side 102C of the patch 102A may further include pre-printed information which is revealed when the patch 102A, or portion thereof, is removed.

In another embodiment, the back side 102C of the patch 102A may include the release agent coating 104 and an area of the front side 101B of the base sheet 101A which is covered by the patch 102A may include an adhesive coating 103.

Thus, the image element 100 may use adhesive materials (e.g., PSA, glues, etc.) 104 on the back side 102C of the patch 102A, or may use patch release materials 104 on the back side 102C of the patch 102A. Similarly, the image element 100 may use adhesive materials 103 on the front side 101B of the base sheet 101A, or the front side 101B of the base sheet 101A may include patch release materials 103. Thus, it is to be understood that in FIG. 1A and FIG. 1B, the layers 103 and 104 may be patch release materials or adhesive materials depending upon the desired fabrication process used, and end use desired, for the image element 100.

It is also noted that the layers 103 and 104 also do not have to coat the entire area represented by the back side 102C of the patch 102A, or the entire area represented by the front side 101B of the base sheet 101A. So, as was discussed above, some portions, such as edges of the back side 102C of the patch 102A, may have no layer 103 or 104 coating while other portions of the back side 102C of the patch 102A may have a layer 103 or 104 coating.

In an embodiment, the patch release materials 103 or 104 may include spot or patterned silicone. This may be done using ultraviolet (UV) or electron beam (EB) cured silicone. Example adhesives 103 or 104 may include hot melt or water-based and UV cured PSA's. It is noted that any suitable patch release 103 or 104 and adhesive material 103 or 104 may be used to affix the patch 102A to the base sheet 101A and provide the functionality to subsequently remove at least some portions of the patch 102A from the base sheet 101A while keeping the integrity of the patch 102A and the base sheet 101A intact.

The base sheet 101A itself may include other materials fabricated thereon. For example, as shown in FIG. 1B, a non-thermally imagable liner or a thermally-imagable liner 101D may be applied to the base sheet 101A before the patch 102A is affixed and integrated with the base sheet 101A. In the case of a non-thermally imagable liner 101D, an area of the base sheet 101A within which the patch 102A is to be affixed may have a liner 101D with an adhesive coating 103 applied. The adhesive coating 103 may be, inter alia, hot melt, water based, or UV/Electron-Beam (EB) cured. In the case where a thermally imagable-liner 101D is used, the liner 101D is adapted to be thermally imaged on a single side. The non-imagable side of the liner is partially or fully siliconized. UV or EB cured silicone may be used and the silicone may comprise a patterned or a continuous layer. An adhesive, such as PSA, is then applied to the silicone side of the liner 101D. The liner 101D is then applied to the base sheet 101A. One or more labels are then die cut from the base sheet. Example, die cut labels are presented with respect to the FIGS. 4A-4D, below.

The patch 102A may be applied to the base sheet 101A in a variety of manners. For example, a release agent 103, such as silicone, may be applied to an area of the base sheet 101A that is to receive the patch 102A. An adhesive 104 is then applied to the back side 102C of the patch 102A. The patch 102A is then laminated to the base sheet 101A. The patch 102A itself may be a label (e.g., an address label, a tag, name identifier, etc.). Additionally, the patch 102A may be subdivided into a plurality of same sized or different sized labels.

In still more arrangements, an edge joined approach may be used. Here, a direct thermal label is attached via its edge to a two-sided thermal base sheet. Any suitable technique may then be used to join the patch 102A (label material) and the base sheet 101A together to form the image element 100.

As one example, consider a retailer's desire to send a product to a customer. The customer's address label comprises a patch 102A that is part of an image element 100, which is affixed to the initial packaging and sent to the customer via a carrier, such as the U.S. Postal service. The customer's address is visible on the front side 102B of the image element, external to the package for the carrier to see and to properly deliver to the customer. Initially when received by the customer, the base sheet 101A includes an area covered by the patch/label 102A and such area may be constructed of a material that is at least partially transparent. The back side 101C of the base sheet 101A is coated with a thermally sensitive ink as is the front side 102B of the patch/label 102A. The image element once fabricated is subsequently fed to a dual-sided thermal printer where an application prints the customer's address label for the specific customer on the front side 102B of the patch/label 102A by selectively applying heat to activate the ink and reveal the customer's address on the front side 102B of the patch/label 102A. At the same time, the dual-sided thermal printer applies heat to the back side 101C of the base sheet 101A over the transparent area and prints a return address label in reverse or mirror image format on the back side 101C of the base sheet 101A, such that when the patch/label 102A is removed from the base sheet 101A a return address is properly visible in the correct orientation from the front side 101B of the base sheet 101A. This permits a return label to be printed on a same image element 100 at the same time that a custom address label is printed for a customer in a single print application and on a single image element 100.

It is noted that a variety of other embodiments may exist as well. For example, information, such as a return address, may be preprinted under a release layer 103 in a thermally sensitive ink coating applied to a front side 101B of a base sheet 101A. The return address is revealed when a smaller, thermally sensitive "send to" address label 102A is removed from the larger label 100. The smaller "send to" address label 102A with adhesive coating 104 is then placed over the original return address for ready return of the package or other item of shipment to the original sender. Other techniques may be used for provision of some or all of the preprinted information on the front side 101B of the base sheet 101A including, inter alia, inkjet, lithographic, relief, flexographic, and/or intaglio printing.

In reference to FIG. 1B, in another case, a return address may be thermally printed on a liner 101D and a send to address may be printed on a label die cut from the patch 102A. Patterned silicone is then deployed such that the return address liner 101D and the send to address label 102A act as both labels and liners. This latter embodiment may be referred to as a "sure return liner" application. In still more cases, a mirror image return liner application may be used such as was described above with the retail application example.

The above examples illustrate but a few of many potential beneficial applications of the image element 100. The embodiments presented herein are not intended to be limited to any particular application; rather all applications that utilize the novel construction and thermally sensitive features of the image element 100 are intended to be covered herein.

Regardless of the design or application, it is also once again noted that the patch 102A need not be the same material as the base sheet 101A; although it can be, if desired. For example, in some cases it may be desirable to have the patch 102A or any label cut or associated with the patch 102A include a coating, such as zinc, which would allow for a full color label to be cut therefrom while the base sheet 101A may support only a single color. Likewise, in other cases it may be desirable to have the patch 102A or any label cut or associated with the patch 102A comprise an opaque substrate, while the base sheet may comprise a transparent substrate, such as for use in return of a package as described above. Additionally, it may be desirable to have one of the base sheet 101A and the patch 102A comprise a higher quality or more expensive material, while the other of the base sheet 101A and the patch 102A comprises a lower quality or lesser expensive material. Other variations are, of course, possible.

According to a further embodiment, an image element 100 may include a variety of patches 102A in configurable locations on a front side 101B and/or on a back side 101C of a base sheet 101A. In fact, a main patch 102A may include one or more separate sub-patches 102A. Each sub-patch 102A includes at least one side that is coated with a thermally sensitive ink. The nested sub-patches 102A may be die cut off of the main patch 102A, such that the main patch 102A includes a plurality of sub-patches 102A. Examples of this may be seen below with reference to FIGS. 4D and 5, discussed below.

Moreover, some areas of a patch 102A, as described above, may include an adhesive (e.g., a PSA, etc.) layer 104, with or without a release agent (e.g., silicone, etc.) layer 103, such that any particular area of the patch 102A may be removed and subsequently affixed to packaging materials or products. For example, the base sheet 101A may include two patches 102A, the first one is removed via a peel off the base sheet 101A while the second one is removed via a punch out or tear and the second one includes its own patch 102A that peels off a back side 102C to expose its own adhesive. The point is that the image element 100 can include a variety of different patches 102A and a patch 102A may include its own patch 102A or sub-patches 102A, such that nesting of patches 102A is achievable.

Regardless of the embodiment, the use and/or type of release agent may depend on, inter alia, the type of adhesive (e.g., removable/repositionable versus aggressive or permanent, etc.) and/or the material used for the base sheet 101A and/or patch 102A (e.g., cellulosic, polymeric, etc.).

Further, the image element 100 is not limited to any particular configuration or architecture. Generally, the image element 100 may include at least a first substrate 101A (base sheet) that includes a front side 101B and a back side 101C either or both of which may be at least partially coated with thermally sensitive ink. The image element 100 may also include at least one second substrate 102A (patch) having a front side 102B and a back side 102C either or both of which may also be at least partially coated with a thermally sensitive ink. In this manner, the image element 100 comprises a multisided thermal media combination which can be subsequently fed to a single-sided or dual-sided thermal printer for purposes of custom printing or imaging one or both sides of the image element 100 while at the same time providing a variety of independent component media portions (e.g., detachable second substrates or patches) 102A which may also be custom printed or imaged.

It is also noted that the front side 101B and/or the back side 101C of the first substrate 101A, and/or the front side 102B and/or the back side 102C of the detachable portion 102A may include pre-printed or pre-imaged information, such as advertisements, logos, and the like. The pre-printed information may have been pre-printed by any number of mechanisms, such as via a thermal printer, via a lithographic printer, via a flexographic printer, or via an inkjet printer. So, the image element 100 may include a variety of information and coatings from a variety of sources. This may be particularly useful for receipts, where a thermal printer may be used to custom print transaction information on one or both sides of an image element 100, while additional information, such as advertisements, coupons, logos and the like, may be custom and/or pre-printed on a further portion of the image element 100, wherein the further portion may be detachable for separate use, storage and/or redemption. Other beneficial situations may also occur where a printing press pre-images or pre-prints information on at least a portion of the image element 100 or its components (substrates 101A and 102A) before the image element 100 is custom imaged or printed to by a thermal printer.

Figure 2A:
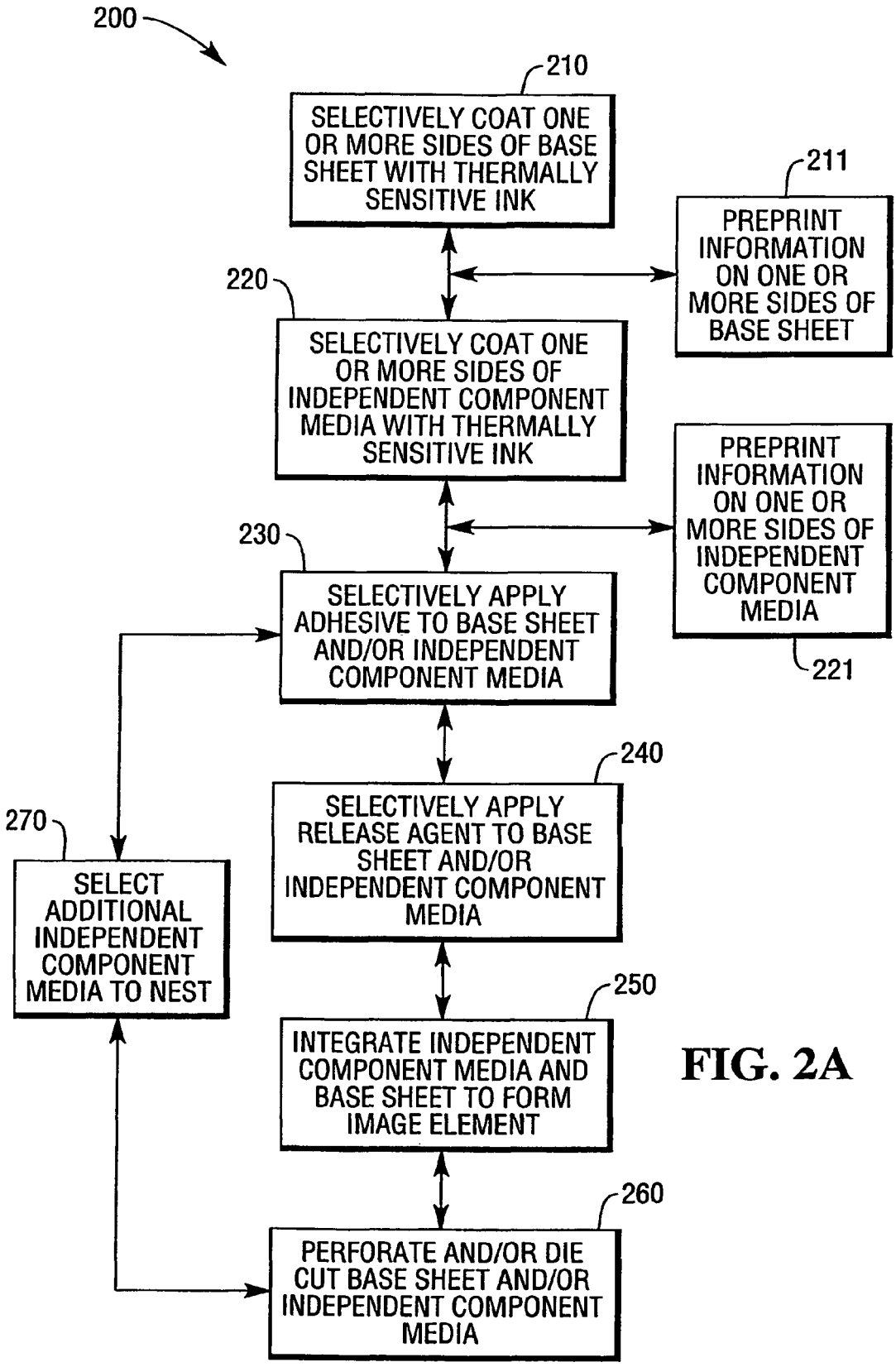
FIG. 2A is a diagram of a method for fabricating an image element, such as the image element presented with the FIG. 1A, according to an example embodiment.

FIG. 2A is a diagram of a method 200 for fabricating an image element, such as the image element 100 presented in FIG. 1A and FIG. 1B, according to an example embodiment. The method (hereinafter referred to as a "fabrication process") is implemented using techniques and devices used in thermal media production and composite media production.

Essentially, the fabrication process of FIG. 2A entails four main steps: 1) production of the base sheet/form; 2) production of the patch combinations to integrate with the base sheet/form; 3) integrating the base sheet/form with the patch combinations; and 4) die cutting labels from the patch and/or base sheet. The resulting unit of media having a form with an integrated label is an image element, such as the image element 100 described with respect to the FIG. 1A and FIG. 1B. Some portions of the resulting image element may include pre-printed information, such as logos, decorative artwork, etc. This printing can occur via any mechanism, such as but not limited to an inkjet, a lithographic printer, a flexographic printer, a thermal printer, etc. Other portions of the resulting image element can be custom printed to using a single-sided or dual-sided thermal printer.

First, the patches (independent component media capable of being at least partially separated from the base sheet) are produced according to desired specifications using desired materials. For example, a roll of siliconized patches maybe produced using one-sided or two-sided direct thermal stock. The patches may be produced on a flexo press. Print on the underside of the silicone may also be achieved if desired. Each patch may be slightly larger than the desired label to be cut there from. Stealth ties may also be used to hold the label in place. In some cases, a coating maybe used between the material of the label and a release agent coating. Stealth ties represent a void in the release agent (e.g., silicone, etc.). Example stealth ties may be found in U.S. Pat. No. 6,746,742, commonly assigned to NCR Corporation of Dayton Ohio; the disclosure of which is incorporated by reference herein.

Next, the base sheet or form is produced. Here, a one-sided or two-sided thermal base sheet is acquired according to desired specifications and dimensions. This may be done as a roll of base sheets. In some cases, the base sheets may be embossed to form a slight depression where the patch is to be subsequently placed. Embossing may be done to decrease the protrusion of the patch above the plane of the base sheet. It is noted that embossing is optional. Finally, the base sheet and the patch are joined together.

It is within this context that the fabrication process is now discussed with reference to FIG. 2A.

At 210, a desired dimension for a base sheet of media is acquired and coated on one or both sides, or portions thereof, with one or more thermally sensitive inks. The mono or multi color inks are not revealed until a required amount of heat is applied to the one or more sides of the base sheet.

According to an embodiment, at 211, the base sheet is pre-printed or imaged with desired information. The pre-printed information may be printed on the one or both sides of the base sheet using any number of mechanisms, such as via a lithographic printer, via a flexographic printer, via an inkjet printer, via a thermal printer, etc.

Concurrently or separately, one or more independent component media (patches or patch combinations) are selected and/or configured in desired dimensions and materials. The independent component media may be the same dimension as the base sheet, or may be smaller in dimensions than the base sheet such that when the independent component media is eventually integrated and/or interfaced to the base sheet at least a portion of the side of the base sheet that includes the independent component media is still visible and free of any independent component media.

At 220, the selected independent component media is selectively coated on at least one side with one or more thermally sensitive inks.

It should be noted that the base sheet may be constructed of multiple materials or a single material. Additionally, the independent component media may be of the same construction and materials, or different construction and materials, as the base sheet.

In an embodiment, at 221, the independent component media may be pre-printed or pre-imaged with information on one or more, or parts of one or more, sides. Again, this pre-printed information may be printed by, inter alia, via lithographic printer, a flexographic printer, an inkjet printer, a thermal printer, etc.

At 230, an adhesive, such as a PSA material, may be selectively applied to the base sheet for purposes of permanently and/or removably affixing the independent component media to the base sheet. Alternately or additionally, at 230, an adhesive, such as a PSA material, may be selectively applied to the independent component media for purposes of permanently and/or removably affixing the independent component media to the base sheet. Depending on the final media design and/or use, a side or portion of the independent component media with or without a thermal coating may subsequently be permanently and/or removably affixed to a side or portion of the base sheet with or without a thermal coating.

Depending upon the type and location of adhesive material, at 240, a release agent, such as silicone, may be selectively applied to a mating surface of the base sheet and/or independent component media. It is noted that the release agent may be applied to a surface where there is no adhesive. Additionally, an adhesive may also be applied to a mating side or surface after application of a release agent. This is referred to as "transfer coating". A release agent, such as silicone, may also be pattern coated to both mating surfaces such that an adhesive material will form a removable bond to the siliconized areas and a permanent bond to the non-siliconized areas when the thermally sensitive media sheets are integrated. In one example, where an adhesive material is applied to some or all of the back side of the independent component media, a release agent may be applied to some or all of the front side of the base sheet. Similarly, where an adhesive material is applied to some or all of the front side of the base sheet, a silicone release layer may be applied to some or all of the back side of the independent component media.

At 250, the independent component media is integrated with the base sheet to form an image element, such integration occurring through selective application of the adhesive and/or release agent as disclosed above.

In an embodiment, at 260, the independent component media and/or base sheet may be perforated or die cut to permit a portion of the independent component media and/or base sheet to be released from the image element. In one such case, a portion of the independent component media may include an adhesive and a mating portion of the base sheet a release agent to permit the portion of the independent component media to be released from the mating portion of base sheet, or vice versa. Alternatively, the independent component media and/or base sheet may include adhesive materials that permit the independent component media and/or base sheet to be affixed to, and removed from, the other.

In some cases, at 270, a variety of additional independent component media may be selected to be nested and integrated with the base sheet and/or previously applied independent component media. Each independent component media serving a desired purpose, such as a return label, an adhesive agent for a return label, an independent form that when folded may be used as a legitimate envelope, as a label for other media (e.g., compact Disk (CD), Digital Versatile Disk (DVD), etc.) or packaging, etc. The potential permutations are boundless.

In fact, many of these constructions may be found in the following patents commonly assigned to NCR Corporation of Dayton Ohio; the disclosures of which are incorporated by reference herein: U.S. Pat. Nos. 6,217,078; 6,331,018; 6,410,113; 6,410,111; 6,423,391; 6,432,499; 6,514,588; 6,589,623; 6,596,359; 6,673,408; 6,699,551; 6,777,054; and 6,746,742. These constructions illustrated in the above references may benefit from the novel modifications described herein to permit multi-sided thermal media constructions or combinations.

The fabrication process of FIG. 2A is only bounded by the desired media application and design specifications, and other fabrication processes are possible. An additional example fabrication process may includes an image element with a single or dual sided base sheet coated with thermally sensitive ink or inks on one or both sides, and at least one integrated independent component media, some or all of which is detachable from the base sheet, including at least one side that is also coated with a thermally sensitive ink or inks. The resultant multi-sided thermal media combination is referred to as an image element. The image element may further include some pre-imaged or pre-printed information in desired locations and on front and/or back sides of the base sheet and/or the independent component media. Additionally, the image element as a whole may be fed to a single or dual sided thermal printer for printing an on-demand print job on the image element, which is produced by the fabrication process illustrated in FIG. 2A or other suitable fabrication processes.

Figure 2B:
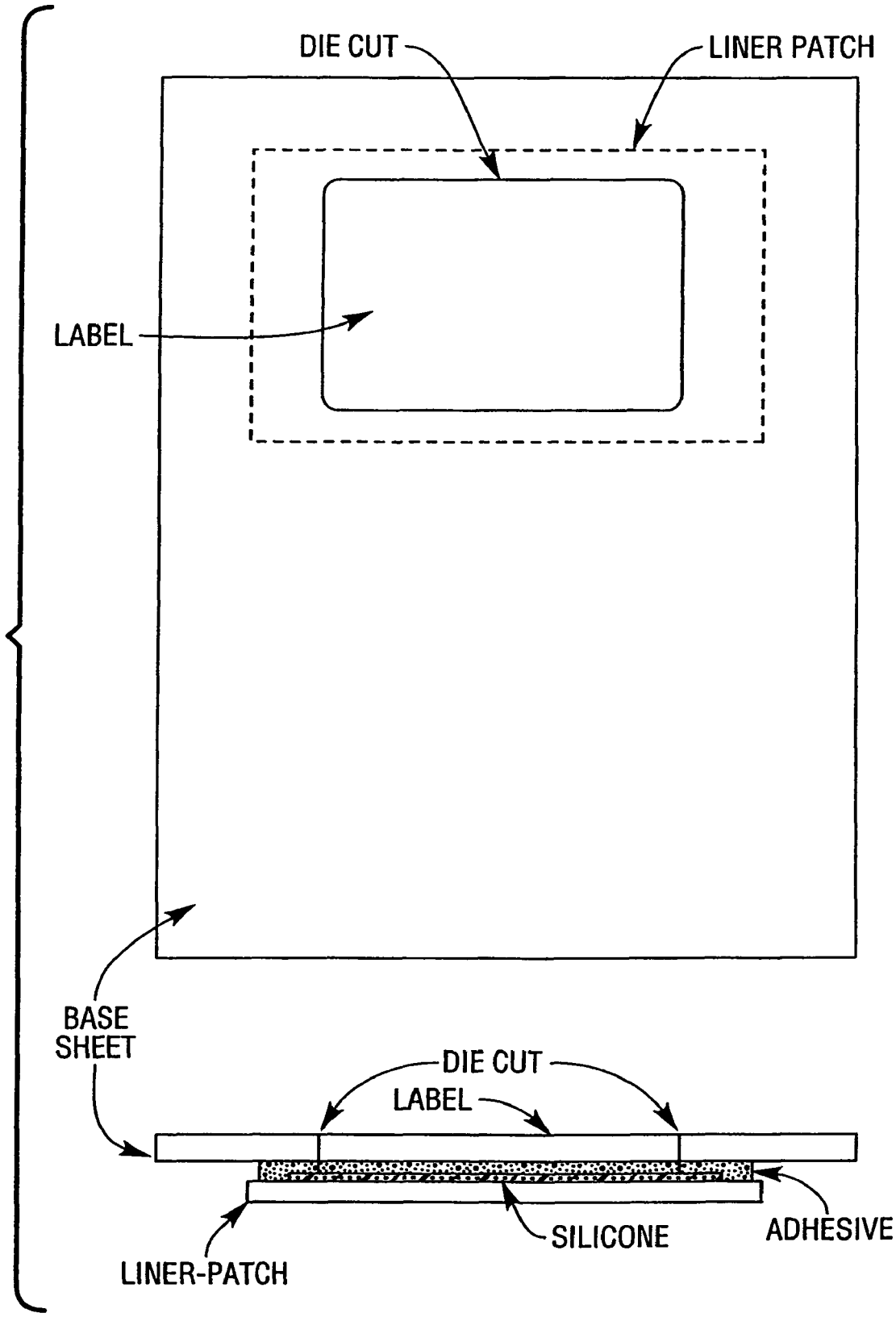
FIG. 2B is an example image element depicting various components and their arrangements, according to an example embodiment.
Figure 2C:
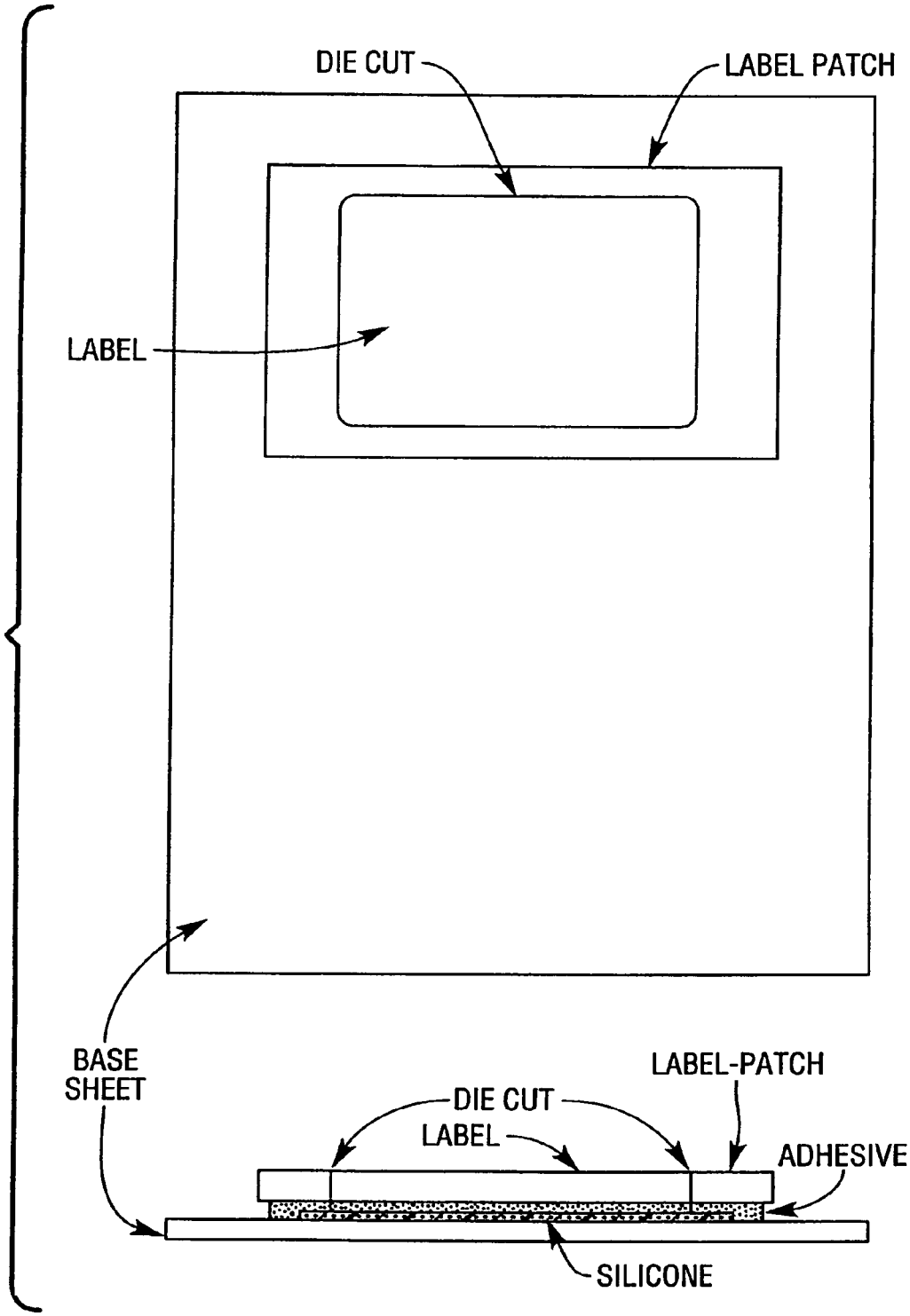
FIG. 2C is another example image element depicting various components and their arrangements, according to an example embodiment.

Some example image elements that may be produced by the method 200 are presented in FIGS. 2B and 2C illustrating some example elements and features described above. FIG. 2B illustrates a liner patch. Conversely, FIG. 2C illustrates a label patch arrangement.

FIG. 2B is referred to as a liner patch because the adhesive material is primarily disposed on the base sheet first and followed by a release agent, such as silicone, shown in the lower view of FIG. 2B representing a side view of the image element. FIG. 2B also demonstrates a scenario where two labels are die cut; one from the patch and one from the back side of the base sheet. The base sheet label is die cut from the back side of the base sheet and is shown in the lower view of FIG. 2B. The other label is die cut from a portion of the patch, shown in the upper view of the FIG. 2B representing a front view of the base sheet.

FIG. 2C is referred to as a label patch because the release agent, such as silicone, is primarily disposed on the base sheet and followed by an adhesive material, shown in the lower view of FIG. 2C representing a side view of the image element. FIG. 2C also demonstrates a similar scenario as was discussed with respect to FIG. 2B, where two labels are die cut; one from the base sheet and one from a portion of the patch. Again, the base sheet has a label die cut from its back side, shown in the lower view of FIG. 2C. The second label is die cut from a portion of the patch, shown in the upper view of the FIG. 2C representing a front view of the base sheet.

Figure 2D:
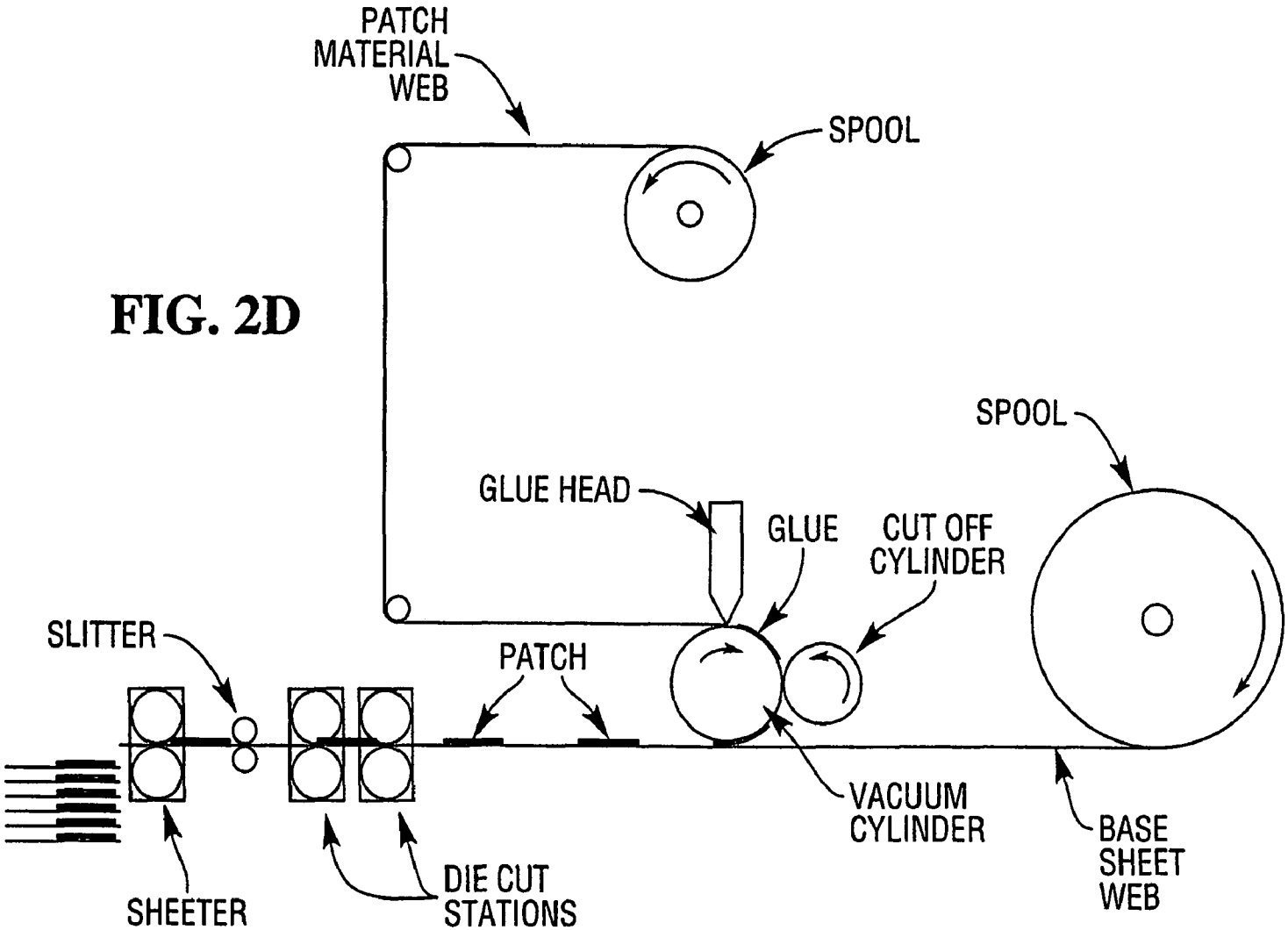
FIG. 2D is an example system for performing the method depicted in FIG. 2A, according to an example embodiment.

FIG. 2D is a block diagram of an example system for achieving the join of a patch and a base sheet to form an image element. In the example system, a pressure sensitive hot melt adhesive (glue) is coated to a back side of the patch material web. It is to be understood that any adhesive may be used, such as but not limited to water-based pressure sensitive adhesives, ultraviolet cured pressure sensitive adhesives (often referred to as "warm melts"), and others.

In FIG. 2D, the base sheet web of thermally sensitive material is on a spool that is unwound. Concurrently, the patch material web is on a spool that is unwound. The patch material web is unwound from the spool onto a vacuum cylinder. A back side of the patch material web receives an adhesive material or glue via a glue head proximate to the vacuum cylinder. After the adhesive is applied, individual patches are then cut from the patch material web via a cut off cylinder. Each individual patch is then released from the vacuum cylinder and pressed onto a front side of the base sheet web. Depending on the adhesive used, and intended design or use of resulting image element, some or all of a front side of the base sheet web and/or the patch material web may be siliconized (e.g., have a release agent coating) to allow some or all of the base sheet and/or patch to subsequently be removed. Next, the base sheet web with the affixed patches enters a die cut station. Here, desired labels are die cut into the patches and/or the base sheet web. The base sheet web continues from the die cut station to a slitter where line holes are removed. Finally, individual image elements are cut from the base sheet web via a sheeter.

After the patch material web receives the adhesive coating it is cut from the web and then laminated to the base sheet. Where a permanent adhesive is used, at the point of lamination the bond between the applied adhesive coating and the non-release agent or non-siliconized portions of the patch and the base sheet becomes permanent. However, the bond between the release agent (e.g., siliconized, etc.) portions of the patch and the base sheet becomes removable. One or more labels are then die-cut from the patch. The labels are cut from the area directly above the release agent (e.g., silicone, etc.). The removable bond between the release agent and the adhesive material keeps the label(s) in-place until the end user removes it or them. Stealth ties and/or regular ties can be used to enhance the bond between the label(s) and base sheet.

Figure 3:
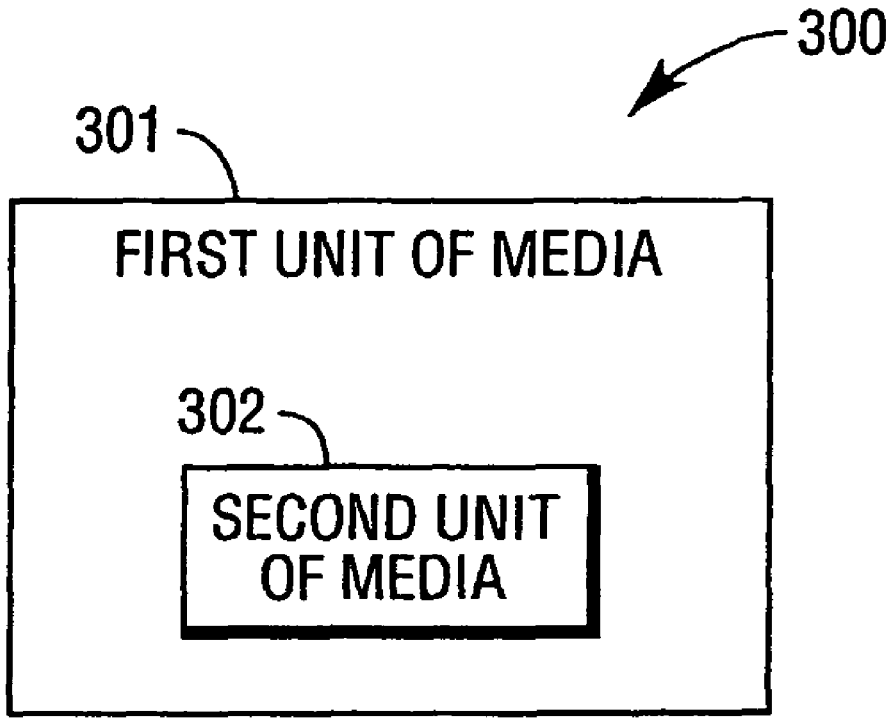
FIG. 3 is a diagram of a multisided thermal media combination system, according to an example embodiment.

FIG. 3 is a diagram of a multisided thermal media combination system 300, according to an example embodiment. The multisided thermal media combination system 300 includes a first unit of media 301 and a second unit of media 302.

The first unit of media 301 may be a base sheet. The first unit of media 301 may include a variety of coatings and materials. Examples of these coatings and materials were presented above with respect to the first substrate 101A of the image element 100 described with reference to the FIG. 1A and FIG. 1B.

The first unit of media 301 is at least partially coated with thermally sensitive ink on one or both sides of the first unit of media 301. One or both sides of the first unit of media 301 may also include pre-printed information acquired previously via any desired printing mechanism, such as but not limited to, a lithographic printer, a flexographic printer, a thermal printer, an inkjet printer, etc. Any pre-printed information may cover only desired portions of one or both sides of the first unit of media 301. Example techniques for fabricating the first unit of media 301 was presented above with reference to the FIGS. 2A-2C.

The second unit of media 302 may be a patch. The second unit of media 302 is also coated on one or both sides with thermally sensitive ink. A back side of the second unit of media 302 is interfaced to an area on the front side of the first unit of media 301. The back side of the second unit of media 302 may include preprinted information and that preprinted information may have previously been acquired via a thermal printer, an inkjet printer, a lithographic printer, a flexographic printer, or other printing mechanisms. Alternately, the front side of the second unit of media 302 may include such preprinted information.

The second unit of media 302 is designed to be integrated with and interface to the first unit of media 301 to form an image element. Integration may be achieved in a variety of manners. For example, an adhesive such as a PSA may be added to some or all of the front side of the first unit of media 301 while a silicone or other release agent coating is added to some or all of the back side of the second unit of media 302. Conversely, a release coating may be added to some or all of the front side of the first unit of media 301 and an adhesive may be added to some or all of the back side of the second unit of media 302. As previously described, patterned adhesive and/or silicone coatings may be used on both the first unit of media 301 and the second unit of media 302 such that select portions of the second unit of media 302 are permanently attached to the first unit of media 301 and additional, select portions of the second unit of media 302 are releasably attached to the first unit of media 301.

In some cases, the second unit of media 302 may have been initially part of the first unit of media 301 and segmented out via a perforation process, such that when the perforation is torn or punched out the second unit of media 302 becomes an independent component media that stands on its own and has its own independent use separate from the first unit of media 301.

The second unit of media 302 affixed to the first unit of media 301 becomes an image element as a whole. The image element may be then fed to a single sided or dual sided thermal printer and imaged or printed according to a desired print job application. This permits on-demand printing on one or both sides of the image element using thermal techniques and permits one or both sides of the first unit of media 301 to be printed to and permits one or both sides of the second unit of media 302 to be printed to.

Additionally, the second unit of media 302 as a whole or at least some portion of the second unit of media 302 may be separated from the image element or the first unit of media 301 and used independently. Examples of this were presented above with reference to the FIGS. 1 and 2A-2B, and are further illustrated below with respect to FIGS. 4A-4D.

FIGS. 4A-4D are example image element configurations, according to example embodiments. FIGS. 4A-4D are presented for purposes of illustration only as there are a variety of additional architectural layouts for an image element that maybe used without departing from the teachings presented herein.

It is noted that a multitude of thermally sensitive media types, including paper, are capable of use within the example illustrations presented with FIGS. 4A-4D. In some cases, just a single side of the thermally sensitive media is capable of being thermally imagable within the example illustrations presented with FIGS. 4A-4D. The combinations presented with each of the FIGS. 4A-4D combine various media components, such as paper, as an integrated whole to form a novel instance of an image element. The positions and dimensions of the various layers and media combinations are also examples and can vary according to desired image elements.

Figures 4A, 4B, 4C, 4D:
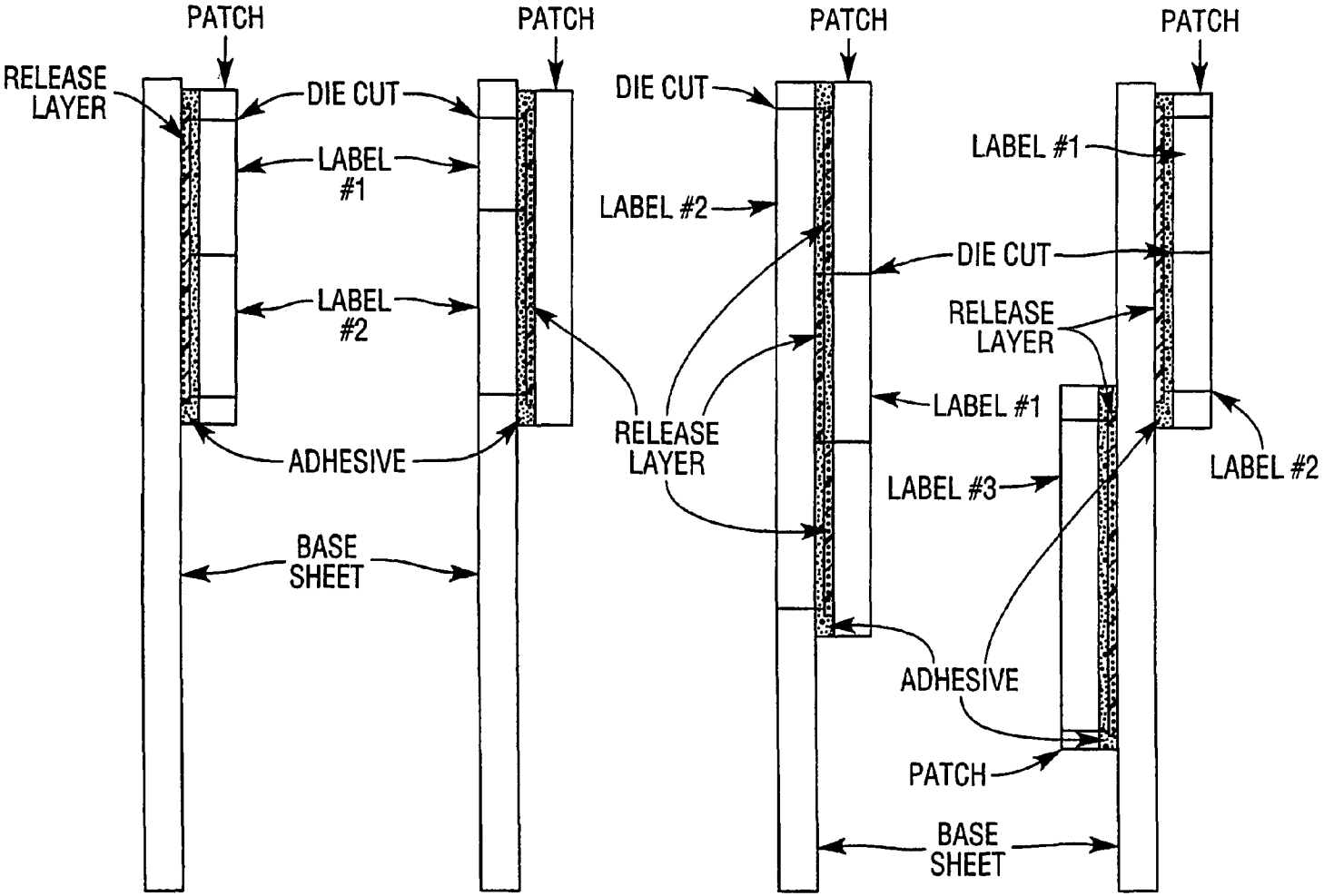
FIGS. 4A-4D are example image element configurations, according to example embodiments.

With this context, FIG. 4A shows an example single or dual sided thermally sensitive media base sheet having a release layer followed by an adhesive layer and a single or dual sided thermally sensitive media patch. Since the base sheet is primarily disposed with the release layer, which is followed by an adhesive; the affixed path is referred to as a label path (see above with respect to FIG. 2C and related discussion). The patch includes a first label, Label #1, and a second label, Label #2; each of which is die cut from the patch. FIG. 4A also demonstrates an edge join for the patch, since the edges of the patch have only adhesive between them and the front side of the base sheet with no additional release layer. This permanently affixes the patch along the edges to the base sheet. This multisided thermal media combination combines as a whole to form an instance of an example image element.

FIG. 4B shows a similar example configuration as FIG. 4A except the adhesive layer and the release layer have been switched, such that the adhesive layer is primarily disposed on the base sheet and not the patch (as it was in FIG. 4A). The arrangement where the adhesive is primarily disposed on the base sheet and then followed by a release layer is referred to as a "liner patch" arrangement (see above with respect to FIG. 2B and related discussion).

Again, in the example image element presented with FIG. 4B the edges of the patch do not include a release layer coating. This permits the patch to be adhered to the base sheet on the edges or corners of the back side of the patch in a further edge join configuration. It also is noted in FIG. 4B that it is the back side of the base sheet that includes die cuts that permit labels (Label #1 and Label #2) on the back side of the base sheet to be removed, such that respective portions of the patch are not removed as independent labels as they were in FIG. 4A.

FIG. 4C shows a multifaceted arrangement, where some portions of the base sheet include coatings for adhesive materials and other portions include release layers (e.g., silicone, etc.). Similarly, the patch includes some portions with release layers and some with adhesive materials. Labels (e.g., Label #1 and Label #2) can be die cut from both the patch (Label #1) and the back side of the base sheet (Label #2). FIG. 4C may also demonstrates that labels can be nested; that is a label may appear within a label. The production of a nested label, or label within a label, may in some cases depend on the position of the die cuts. This architectural arrangement may also be used to illustrate patterned or spot silicon or release agent coatings on both the patch and the base sheet. It should be noted that it may also be possible to thermally print through the release layer portions such that a portion patch or base sheet, such as Label #2, with a release agent may be thermally imaged after being removed from image element, or after a mating portion of a patch or base sheet, such as Label #1, is removed, among other combinations.

FIG. 4D illustrates still another configuration where a middle thermally sensitive media (base sheet) includes other thermally sensitive media on each side of the middle media. In this case, two separate patches are shown: one affixed via an edge join on the front and top side of the base sheet and one affixed via an edge join on the back side and bottom side of the base sheet. In other words, FIG. 4D is illustrative of an image element having a single base sheet patches on both sides. FIG. 4D also illustrates two die cut labels (Label #1 and Label #2) on the patch affixed via an edge join configuration on the front side of the base sheet, and a third label (Label #3) on the patch that is affixed via an edge join configuration on the bottom side of the base sheet. Both patches are label patches because the base sheet on both the front and back sides where the patches are edge joined are primarily disposed with the adhesive and subsequently followed by a release layer.

Any thermally sensitive media depicted in FIGS. 4A-4D may be coated on both sides if desired. However, there may generally be no thermal coating on portions of the media that are directly coated with adhesive material. Moreover, it is generally just desirable to coat those sides of the media that can be directly heated by a thermal printer when the image element as a whole is fed to a single sided or dual sided thermal printer. But is it noted that prior to fabrication of the image element unexposed sides of the thermal media may have been previously thermally imaged, such that the unexposed sides are or were in fact also thermally coated before the image element as a whole was fabricated.

Again, FIGS. 4A-4D are presented for illustration and comprehension only and are not intended to limit the teachings presented herein to just what is illustrated.

Figure 5:
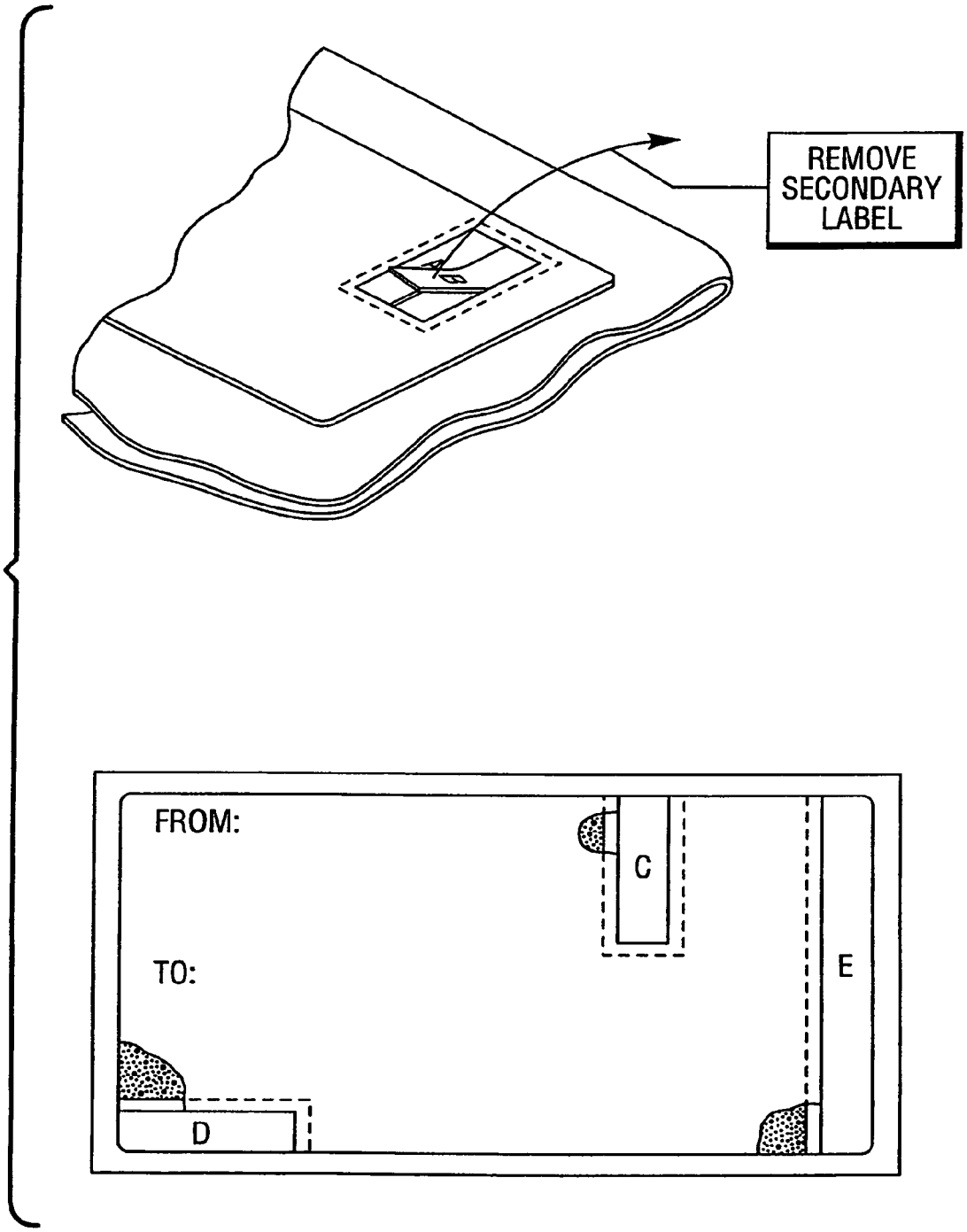
FIG. 5 is a diagram illustrating a label within a label combination for an image element, according to an example embodiment.

FIG. 5 illustrates a label within a label, or a nested combination of the components discussed herein and above. There are two illustrations shown in FIG. 5. In the top illustration, the items identified as A and B are themselves included on a label and thus A or B may be viewed as a label within a label. The arrow indicates that these labels A and B are capable of being removed as secondary labels. The main label and the labels within the label are coated with thermally sensitive ink and are capable of being imaged via a thermal printer.

In a similar manner, the bottom figure in the FIG. 5 shows labels within a main label as C, D, and E. The number and arrangements of labels within labels are configurable. FIG. 5 is used to demonstrate that nested components may occur within components of the thermally sensitive media of the image element. So, a thermally sensitive label may itself include other detachable thermally sensitive labels.

The above description is illustrative, and not restrictive. Many other embodiments will be apparent to those of skill in the art upon reviewing the above description. The scope of embodiments should therefore be determined with reference to the appended claims, along with the full scope of equivalents to which such claims are entitled.

The Abstract is provided to comply with 37 C.F.R. §1.72(b) and will allow the reader to quickly ascertain the nature and gist of the technical disclosure. It is submitted with the understanding that it will not be used to interpret or limit the scope or meaning of the claims.

In the foregoing description of the embodiments, various features are grouped together in a single embodiment for the purpose of streamlining the disclosure. This method of disclosure is not to be interpreted as reflecting that the claimed embodiments have more features than are expressly recited in each claim. Rather, as the following claims reflect, inventive subject matter lies in less than all features of a single disclosed embodiment. Thus the following claims are hereby incorporated into the Description of the Embodiments, with each claim standing on its own as a separate exemplary embodiment.

The invention claimed is:

1. An image element, comprising:

a first substrate having a front side and a back side, wherein at least a portion of the front side and the back side is coated with a thermally sensitive ink; and a second substrate having a front side and a back side, wherein at least a portion of the front side is coated with a thermally sensitive ink; and wherein the second substrate is at least partially affixed to the front side of the first substrate.

2. The image element of claim 1, wherein at least a first portion of the back side of the second substrate includes an adhesive to removably affix the first portion of the second substrate to the front side of the first substrate.

3. The image element of claim 2, wherein at least a first portion of the front side of the first substrate is coated with a release agent to permit the first portion of the second substrate to be removed from the front side of the first substrate.

4. The image element of claim 3, wherein at least a second portion of the back side of the second substrate is coated with an adhesive to permanently affix the second portion of the back side of the second substrate to the front side of the first substrate.

5. The image element of claim 3, wherein the release agent comprises silicone.

6. The image element of claim 1, wherein the second substrate is at least partially affixed to the front side of the first substrate through use of a pressure sensitive adhesive.

7. The image element of claim 1, further comprising a third substrate having a front side and a back side, wherein the front side of the third substrate is coated with a thermally sensitive ink, and the back side of the third substrate is capable of being at least partially affixed to the front side of the second substrate.

8. The image element of claim 1, further comprising a third substrate having a front side and a back side, wherein the front side of the third substrate is coated with a thermally sensitive ink, and the back side of the third substrate is capable of being at least partially affixed to the back side of the first substrate.

9. The image element of claim 1, wherein at least a portion of the second substrate is capable of being removed from the first substrate to reveal at least one of the following:

a perforated portion of the first substrate, and wherein the perforated portion is a removable address label;

an address label pre-printed on the front side of the first substrate;

an address label pre-printed in reverse image format on the back side of at least a portion of the first substrate, wherein the at least a portion of the first substrate is transparent; and an address label printed on the back side of the second substrate.

10. A method, comprising:

selecting a first substrate having a front side and a back side, wherein at least a portion of the front side and the back side of the first substrate are coated with thermally sensitive ink;

selecting a second substrate having front side and a back side, wherein at least a portion of the front side of the second substrate is coated with thermally sensitive ink;

integrating the second substrate onto the first substrate, wherein at least a portion of the second substrate is removable from the first substrate once integrated.

11. The method of claim 10 further comprising, die cutting removable labels from one or more of the first substrate and the second substrate, each label die cut from the substrate to which it relates.

12. The method of claim 10, wherein integrating the second substrate onto the first substrate comprises joining the second substrate to the first substrate via an edge join adhesion technique.

13. The method of claim 10 further comprising, pre-imaging information on one or more portions of the first and the second substrates.

14. An image element, comprising:

a single-sided thermally imagable base sheet;

a two-sided thermally imagable patch;

an adhesive layer; and a release layer, wherein the adhesive layer is applied to at least a portion the single-sided thermally imagable base sheet, and the release layer is applied to at least a portion of two-sided thermally imagable patch such that the two-sided thermally imagable patch is fixably attached to the single-sided thermally imagable base sheet over the portion of the single-sided thermally imagable base sheet and removably attached to the single-sided thermally imagable base sheet over the portion of the two-sided thermally imagable patch.

15. The image element of claim 14, wherein the single-sided thermally imagable base sheet comprises a different substrate than the two-sided thermally imagable patch.

16. The image element of claim 14, wherein the adhesive layer comprises one of an ultraviolet or an electron beam pressure sensitive adhesive material.

17. The image element of claim 14, wherein the release layer comprises one of a spot pattern or a continuous layer.

* * * * *